United States Patent [19]

Morrison

[11] Patent Number: 4,584,462

[45] Date of Patent: Apr. 22, 1986

[54] HAIRSETTER FOR ELECTRICALLY HEATING FLEXIBLE HAIR CURLERS

[75] Inventor: Herbert M. Morrison, Trumbull, Conn.

[73] Assignee: Clairol Incorporated, New York, N.Y.

[21] Appl. No.: 671,343

[22] Filed: Nov. 14, 1984

[51] Int. Cl.[4] ..... A45D 2/18; A45D 4/12; H05B 3/00

[52] U.S. Cl. ..... 219/222; 132/33 R; 132/43 R; 132/44; 219/242; 219/387; 219/521; 219/530

[58] Field of Search ..... 219/222, 242, 520, 521, 219/386, 387, 530, 540; 132/43 R, 43 A, 44, 33 R

[56] References Cited

U.S. PATENT DOCUMENTS

| | | | |
|---|---|---|---|
| 1,554,800 | 9/1925 | Dodge | 219/242 |
| 1,694,725 | 11/1928 | Tabb | 219/242 |
| 2,061,817 | 11/1936 | Van Cleef | 132/44 |
| 2,074,816 | 3/1937 | Trotter | 132/43 A |
| 2,487,161 | 11/1949 | Melton | 219/521 |
| 3,585,357 | 6/1971 | Mandell et al. | 219/242 X |
| 3,946,196 | 3/1976 | Waters et al. | 219/242 X |
| 4,298,787 | 11/1981 | Barradas | 219/242 X |

FOREIGN PATENT DOCUMENTS

| | | | |
|---|---|---|---|
| 503975 | 4/1939 | United Kingdom | 219/242 |
| 665180 | 1/1952 | United Kingdom | 219/242 |

*Primary Examiner*—A. Bartis
*Attorney, Agent, or Firm*—G. Warzecha

[57] ABSTRACT

A hairsetter for electrically heating a plurality of flexible hair curlers includes a thermally insulated hollow container receiving therein a plurality of vertically disposed elongated flexible hair curlers arranged in a pair of rows. The curlers are heated by a heat sink core portion disposed between the curler rows and in heat conductive contact with the curlers. The heat sink core portion includes a flat electrical resistance heater plate sandwiched between two electrically insulating boards covered by two oppositely facing metallic heat sink members. The heat sink members each have a plurality of vertical channels receiving and contacting a respective one of curlers of a curler row for conducting heat to the curler from the heater plate. The rows of curlers are disposed in a tiered arrangement to facilitate removal of the heated curlers from the container through a top opening on the container closed by a hinged cover.

2 Claims, 4 Drawing Figures

HAIRSETTER FOR ELECTRICALLY HEATING FLEXIBLE HAIR CURLERS

BACKGROUND OF THE INVENTION

1. Field of the Invention

This invention relates to heaters for heating hair curlers. In particular, this invention relates to hairsetters for heating elongated flexible hair curlers.

2. Description of the Prior Art

Elongated flexible hair curlers have been known for quite some time. Such curlers generally comprise cylindrical bodies made of resilient material such as foam or sponge rubber and have a wire or soft metal core embedded within the body along the axis of the curler. An elongated flexible curler is much longer than an inflexible curler in order to enable it to be bent over on itself to retain a hair tress wound thereon. This avoids the necessity of a clip to hold the hair as is required with inflexible curlers. Elongated flexible curlers also may be bent in a variety of positions after hair is wound thereon and thus may impart a variety of waves to the hair. The metal core enables the curler to be bent and to retain the position it is placed in until it is bent into another position.

It is well known that heating hair that is wound upon hair curlers, curling irons, etc. will facilitate setting a curl in the hair, whether it is wet or dry. Devices used to heat hair curlers are generally called "hairsetters" and many such prior art devices are known for heating inflexible, rigid hair curlers. An example of such a hairsetter is shown in U.S. Pat. No. 3,858,029 showing a heating unit having a plurality of heating posts for receiving hair curlers thereon, each hair curler having a longitudinal base surrounded by a heat absorbing wax-filled container. However, no hairsetters are known that are suitable for heating elongated flexible hair curlers.

The known flexible curlers are generally not heated prior to use although heatable flexible curlers are shown in a copending commonly assigned application entitled Heatable Flexible Hair Curlers Ser. No. 671,157 filed Nov. 14, 1984. There is only one known prior art example of a heatable flexible hair curler. U.S. Pat. No. 2,074,816 shows an elongated flexible hair curler having an absorbent casing filled with a material such as calcium oxide which when moistened generates heat. The curler disclosed in this patent is incapable of generating heat in use with dry hair.

It ia an object of this invention to provide a hairsetter for elongated flexible curlers capable of heating a plurality of such curlers to a predetermined temperature.

SUMMARY OF THE INVENTION

These and other objects are achieved by the preferred embodiments of this invention which is an apparatus for heating a plurality of heatable, flexible hair curlers comprising a container for receiving said curlers therein in a substantially longitudinal, unbent position, said container having a thermally insulated external surface and a core portion for receiving said curlers adjacent thereto, said core portion comprising: a central heat source within said core portion and means for communicating energy thereto to heat same; and spacing means adjacent said heat source for spacing said rollers from said heat source and from each other.

In the preferred embodiment the curlers are arranged within the container in rows and the container further comprises tier means therewithin in order to elevate the ends of one row of the curlers above the ends of an adjacent row of curlers.

DESCRIPTION OF THE PREFERRED EMBODIMENT

Figure 1:
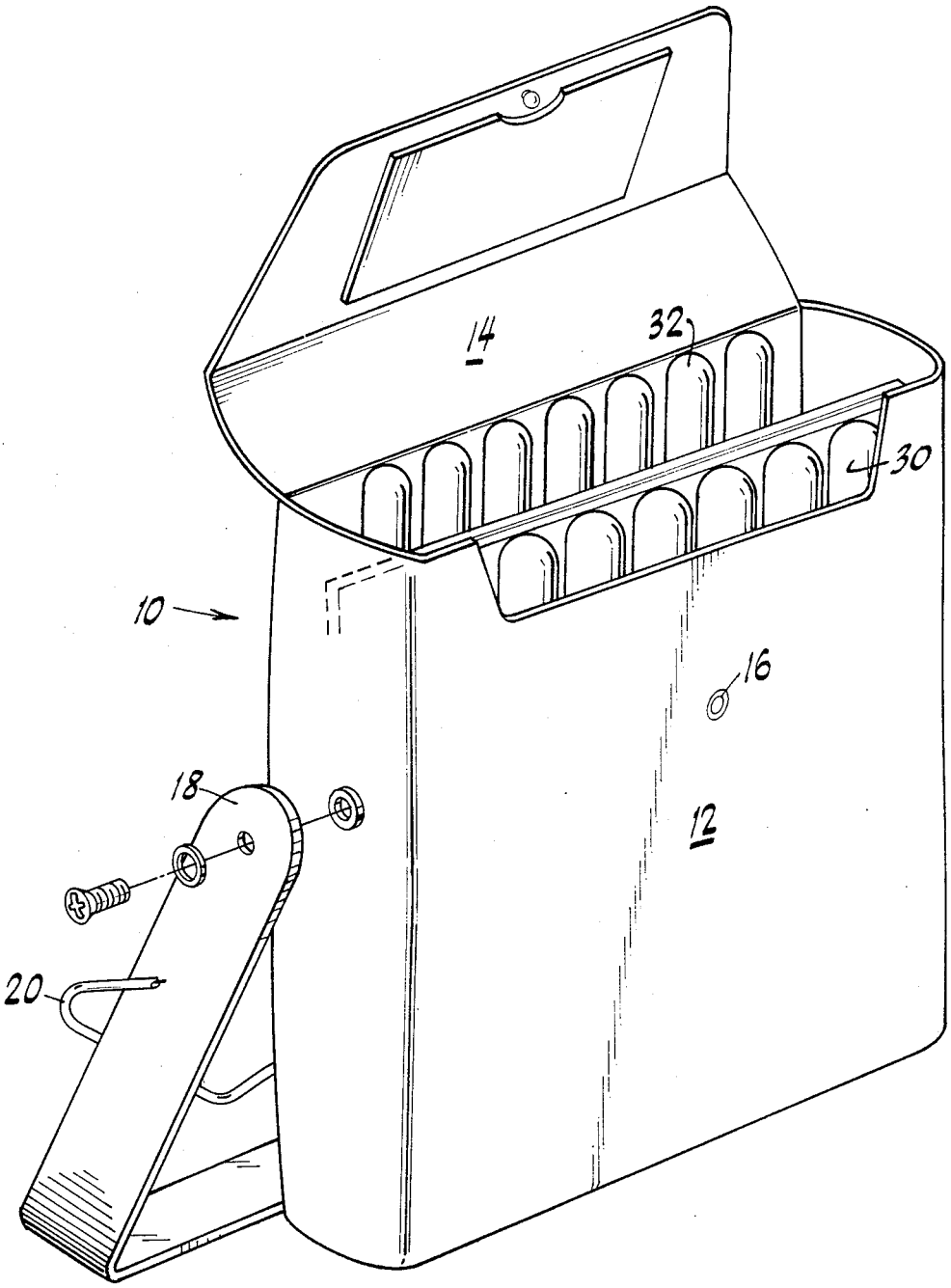
FIG. 1 shows a perspective view of the exterior of the hairsetter constructed in accordance with the principles of this invention.

Referring now to FIG. 1 there is shown a perspective view of hairsetters 10 constructed in accordance with the principles of this invention. Hairsetter 10 comprises a generally rectilinear body portion 12 and a hinge cover portion 14. A snap latch 16 is provided to secure cover 14 to body 12. A pivotable handle 18 is provided which also may serve as a stand. A power cord 20 is provided to provide power to the internal components of the hairsetters described below.

The internal components of hairsetters 10 are designed to receive curlers 30 and 32 in a tiered configuration in order to facilitate access to the rear row of curlers.

Figure 2:
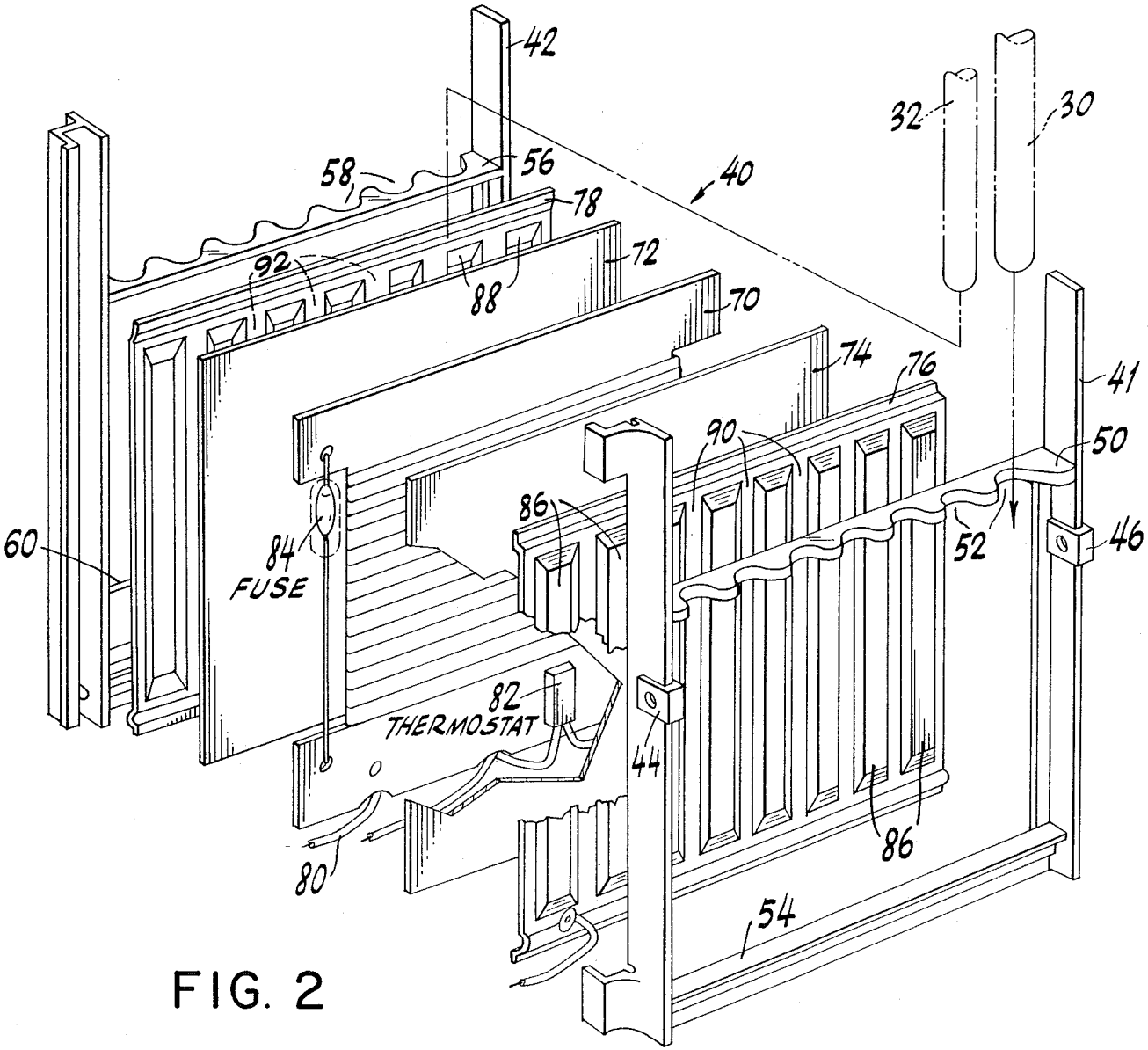
FIG. 2 shows an expanded perspective view of the interior of the hairsetters shown in FIG. 1.

As best seen in FIG. 2, the internal components of hairsetters 10 comprises a core portion 40 having a front frame 41 and rear frame 42 designed to mate therewith. Front frame 41 is provided with nuts 44 and 46 for receiving the same screws that secure handle 18 to hairsetter 10 in order to retain the frame within the body of the hairsetter.

Front frame 41 is provided with a corrugated bracket 50, the indentations 52 of which are sized to receive rollers 30, the diameter of which may be, for example, 16 millimeters. A ledge 54 is also provided upon which the bottom end of the rollers 30 may rest. Rear frame 42 is provided with a corrugated bracket 56 the indentations 58 of which are sized to receive rollers 32, the diameter of which may be, for example, 11 millimeters. Rear frame 42 is provided with a ledge 60 which is somewhat higher than ledge 54 in order to have a tiered effect with the rear row of rollers raised higher than the front row.

In between front and rear frames 41 and 42 a heater card 70 is sandwiched between insulator boards 72 and 74, front heat sink 76 and rear heat sink 78.

In the preferred embodiment, heater card 70 is a wire resistance heater receiving power from power line 80 and having a thermostat 82 and fuse 84. Alternatively, other energy sources (such as butane catalytic heat sources, etc.) may be used to provide heat. Thermostat 82 may, for example, have a cutoff in the area of 80° C. while fuse 84 is provided as a backup safety feature to blow at a temperature equivalent of approximately 150° C. Insulator boards 72 and 74 may be, for example, Nomex or Mica boards serving to electrically insulate the heat sinks from the heater card as well as serving to more uniformly distribute the heat.

Figure 3:
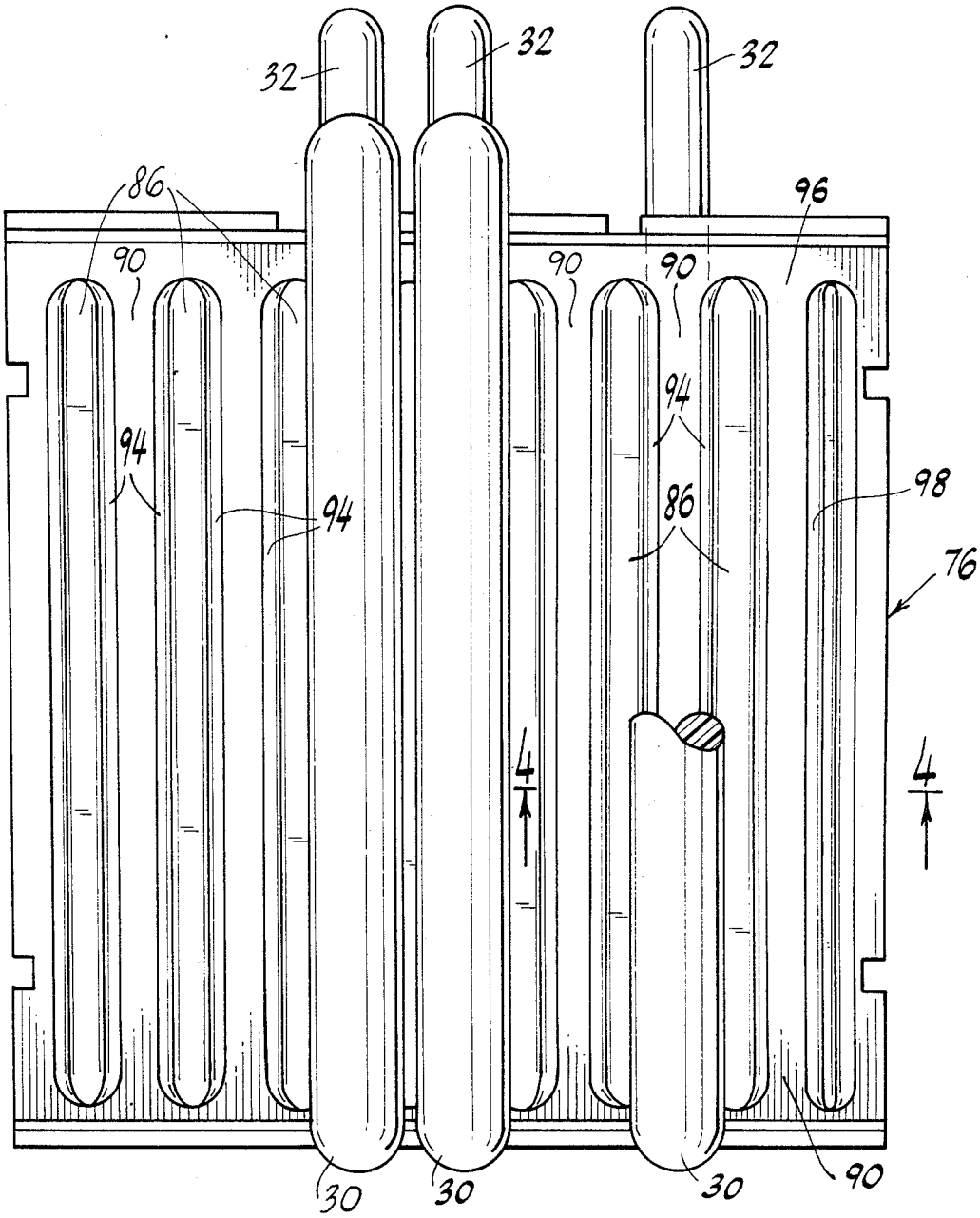
FIG. 3 shows a front elevational view partially cut away, of a portion of the invention.
Figure 4:
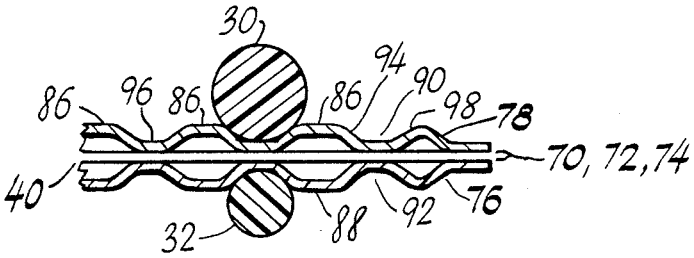
FIG. 4 shows a diagrammatic cross-sectional view of a portion of FIG. 3 taken along line 4-4 thereof and showing the relationship between the curlers and the heat sinks of the invention.

Heat sinks 76 and 78 may be stamped in the design as shown from a good heat conductive material such as aluminum alloy 1100. Each heet sink is stamped with a plurality of parallel, longitudinal generally rectilinear projections 86 and 88 respectively. Adjacent projections 86 and the longitudinal space 90 therebetween are sized to receive roller 30 as best seen in FIG. 4. Each space 90 is aligned with a corresponding indentation 52. Similarly, projections 88 and the spaces 92 between adjacent projections are sized to receive rollers 32, the spaces 92 being aligned with indentations 58. As best seen in FIG. 4, the various dimensions of the projections 86 (and 88) and spaces 90 (and 92) are chosen to insure good thermal transfer between each heat sink and the rollers placed adjacent thereto by assuring that the cylindrical surface of each roller contacts surfaces 94, 96 and 98. It will be understood that projections 86 and 88 are shown for clarity in FIG. 2 as having squared corners while in practice it is desirable to round off these corners (as best seen in FIG. 3) to relieve stress points.

In operation it will be understood that hairsetter 10 may receive any number of rollers 30 and 32 up to the number of indentations 52 and 58 available. The hairsetter will attain a predetermined temperature (as a function of thermostat 82) and after a certain amount of time thermal equilibrium will be achieved within the interior of the hairsetter so that all rollers 30 and 32 will be heated to the desired temperature.

It will be understood by those skilled in the art that numerous modifications and improvements may be made to the preferred embodiment of the invention disclosed herein without departing from the spirit and scope hereof.

What is claimed is:

1. An apparatus for heating a plurality of heatable hair curlers comprising:

a hollow container for receiving a plurality of curlers therein in a substantially longitudinal unbent position, said container having a thermally insulated external surface;

a heat sink core portion within said container for receiving the plurality of curlers adjacent thereto, said core portion having thermally conductive, flat front and back faces each provided with a plurality of parallel, longitudinal channels, each channel adapted to contact a portion of a respective one of the curlers received within said container;

a flat heat source centrally mounted between said front and back faces in heat exchange relationship therewith for heating said faces; and means for communicating energy to said heat source.

2. An apparatus according to claim 1 comprising tier means within said container to elevate the ends of predetermined ones of the curlers above the ends of other of the curlers.

* * * * *